US008079410B2

(12) United States Patent
Kim

(10) Patent No.: US 8,079,410 B2
(45) Date of Patent: Dec. 20, 2011

(54) EXHAUST GAS RECIRCULATION COOLER AND METHOD

(75) Inventor: IlHwan Kim, Asan (KR)

(73) Assignee: Modine Manfacturing Company, Racine, WI (US)

( * ) Notice: Subject to any disclaimer, the term of this patent is extended or adjusted under 35 U.S.C. 154(b) by 1189 days.

(21) Appl. No.: 11/824,623

(22) Filed: Jul. 2, 2007

(65) Prior Publication Data

US 2008/0047685 A1 Feb. 28, 2008

(30) Foreign Application Priority Data

Jul. 3, 2006 (KR) ..... 10-2006-0061857

(51) Int. Cl.
*F28F 9/22* (2006.01)

(52) U.S. Cl. ..... 165/161; 165/159; 165/176

(58) Field of Classification Search ..... 165/161, 165/176

See application file for complete search history.

(56) References Cited

U.S. PATENT DOCUMENTS 1,787,086 A * 12/1930 Pew, Jr. ..... 165/161
1,862,310 A * 6/1932 How ..... 165/158
1,990,251 A * 2/1935 Potter ..... 165/82
2,263,397 A * 11/1941 Rathbun ..... 165/161
2,797,898 A * 7/1957 Fabregas et al. ..... 165/110
3,805,887 A * 4/1974 Smith ..... 165/76
4,142,578 A * 3/1979 Smith ..... 165/81
4,147,209 A * 4/1979 Persson ..... 165/161
6,955,213 B2 10/2005 Stonehouse et al.

FOREIGN PATENT DOCUMENTS

EP 0987427 3/2000
KR 1020010108767 A1 12/2001
KR 1020040054193 A1 6/2004

* cited by examiner

*Primary Examiner* — Allen Flanigan
(74) *Attorney, Agent, or Firm* — Michael Best & Friedrich LLP

(57) ABSTRACT

An EGR cooler having an inlet/outlet tube installed by insertion is provided, and can have a curved gas flow path defined at least in part by a tank body. The inlet/outlet tube can include a first inlet/outlet tube and a second inlet/outlet tube to introduce and to exhaust gas. The tank body can have a configuration such that a connection housing is installed to establish fluid communication between individual ends of both the first inlet/outlet tube and second inlet/outlet tube, so that heat exchange efficiency between the inflow gas and the cooling fluid can be improved, and effective space utilization can be promoted in equipping an vehicle with the EGR cooler.

14 Claims, 5 Drawing Sheets

Figure 1 - Prior Art
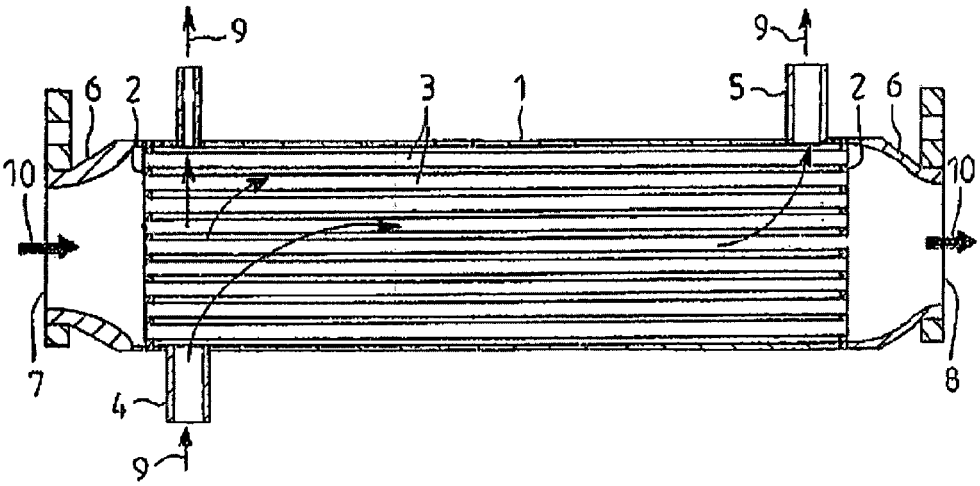
Figure 2
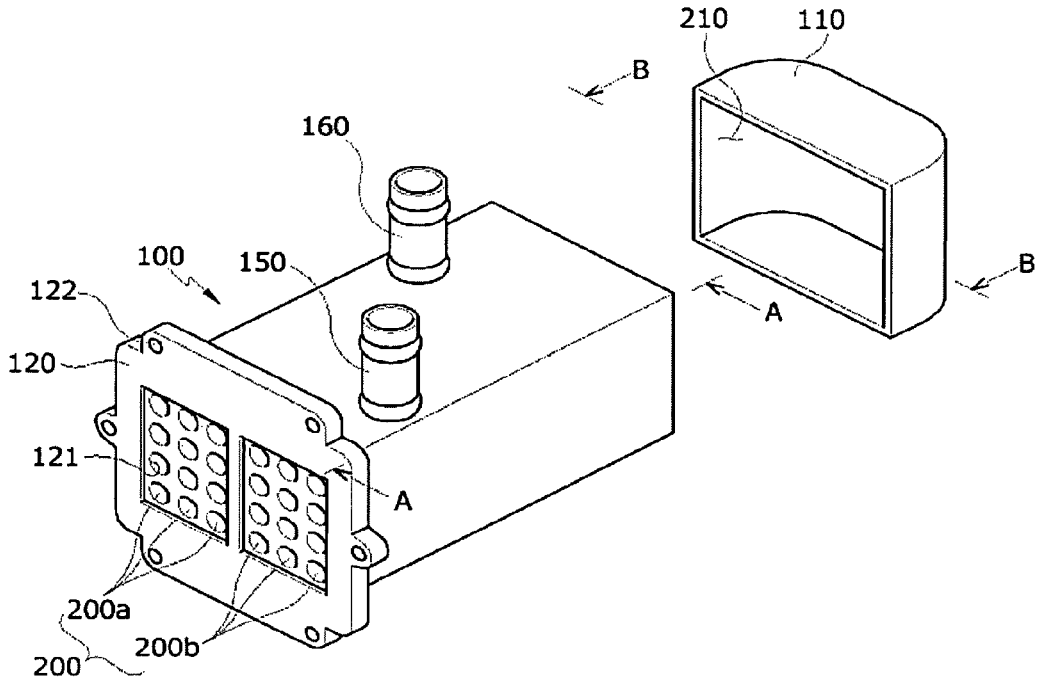

EXHAUST GAS RECIRCULATION COOLER AND METHOD

CROSS-REFERENCE TO RELATED APPLICATIONS

Priority is hereby claimed to Korean Patent App. No. KR 2006-061857 filed on Jul. 3, 2006, the entire contents of which are incorporated herein by reference.

BACKGROUND

In general, the exhaust gas of an automobile contains large quantities of harmful substances including carbon monoxides, nitrogen oxides, and hydrocarbons. While the production of harmful substances such as nitrogen oxides often increases in quantity with the temperature of an engine, EGR (Exhaust Gas Recirculation) is used to decrease such harmful substances by recirculating exhaust gas into an intake system and lowering the combustion temperature in a cylinder. In many EGR processes, an EGR cooler is installed that is intended to cool high-temperature exhaust gas with cooling water.

FIG. 1 is a vertical cross-sectional view illustrating an EGR cooler according to the prior art. As illustrated in FIG. 1, the EGR cooler is comprised of a cylindrical cell 1, plates 2 installed at both ends of the cell 1 to close both ends of the cell 1, and a plurality of tubes 3 that penetrate through the plates 2 and extend and are installed in the internal shaft center of the cell 1. Here, the cell 1 is furnished with a cooling water inlet 4 and a cooling water outlet 5 at its two sides so that cooling water 9 introduced from the cooling water inlet 4 can move along the exterior of the tubes 3 and can be discharged through the cooling water outlet 5. In addition, tanks 6 on which an exhaust gas inlet 7 and an exhaust gas outlet 8 are formed, respectively, are installed at each end of the cell 1 so that exhaust gas 10 introduced from the exhaust gas inlet 7 can exchange heat with the cooling water 9, and can then be discharged through the exhaust gas outlet 8.

However, as exhaust gas undergoes horizontal movement through straight tubes in EGR coolers according to the prior art, effective contact between the tubes and cooling water often does not take place, and the time allowed for heat exchange therebetween becomes short. Consequently, heat transfer to the cooling water that moves around the exhaust gas and the tubes often does not take place effectively. As a result, heat exchange efficiency can suffer remarkably.

In addition, in the event that the flow of exhaust gas becomes weak in the tubes, soot and other material in the exhaust gas can accumulate in flow pathways, thereby interfering with the flow of exhaust gas. Furthermore, existing straight EGR coolers can restrict positioning and installation of other parts in a vehicle, where space is typically at a premium. Such restrictions can negatively impact the efficient and effective positioning and installation of parts within a vehicle.

SUMMARY OF THE INVENTION

Some embodiments of the present invention relate to EGR coolers, and specifically, with EGR coolers in which an inlet/outlet tube is installed by insertion such that a curved gas flow path may be formed on a tank body into which cooling fluid enters, and subsequently, heat transfer between cooling fluid and gas takes place effectively.

In some embodiments, an EGR cooler is provided that promotes effective heat transfer between gas and cooling fluid, thereby increasing heat exchange efficiencies. The EGR cooler can also promote smooth flow of the gas introduced, and can prevent accumulation of impurities contained in the gas.

In some embodiments, an EGR cooler is provided, and comprises a tank body through which cooling fluid enters and exits; a tube within the tank body and at least partially defining a gas flow path through the tank body, the tube comprising a first portion through which gas entering the EGR cooler passes, and a second portion through which gas exiting the EGR cooler passes; a connection housing establishing fluid communication between the first and second portions of the tube; wherein the first and second portions of the tube and the connection housing collectively define a curved gas flow path through the EGR cooler.

Some embodiments of the present invention provide an EGR cooler, comprising a tank having a first portion within which extends a first set of tubes and a second set of tubes, and a second portion establishing fluid communication between the first and second sets of tubes, the first and second portions collectively defining a U-shaped flow path for exhaust gas through the EGR cooler; a coolant inlet; and a coolant outlet; wherein the second portion of the tank has a curved interior surface along which exhaust gas flows from the first set of tubes to the second set of tubes.

BRIEF DESCRIPTION OF THE DRAWINGS

In the drawings, wherein like reference numerals indicate like parts:

FIG. 1 is a vertical cross-sectional view illustrating the EGR cooler according to the existing art.

FIG. 2 is an exploded perspective view illustrating the EGR cooler according to an embodiment of the present invention.

Figure 3A:
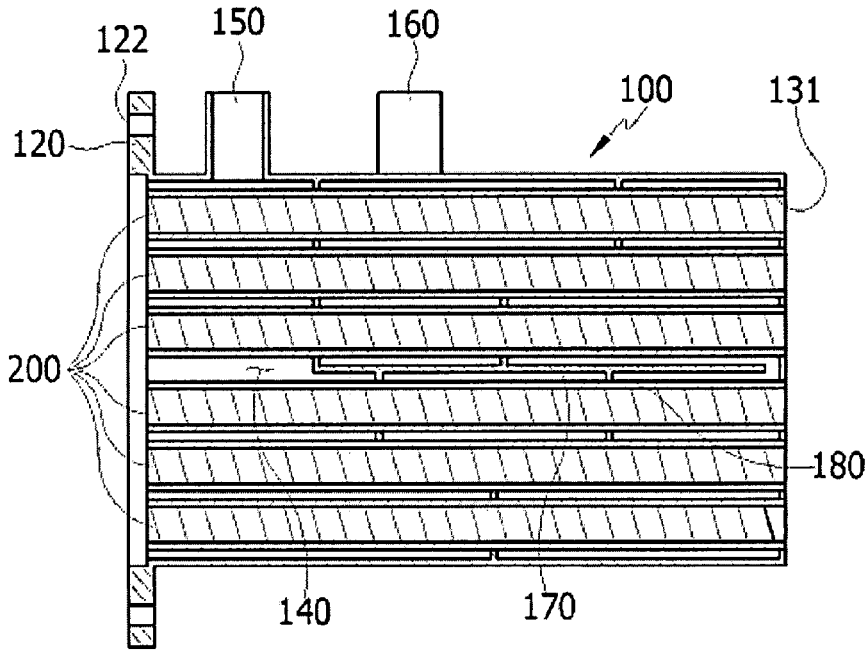
FIG. 3*a* is a vertical cross-sectional view of a portion of the EGR cooler shown in FIG. 2, shown from "AA" in FIG. 2.

Before the embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as a limitation of the present invention.

DETAILED DESCRIPTION

Some embodiments of present invention provide an EGR cooler comprising a tank body through which cooling fluid enters and exits, and an inlet/outlet tube installed by insertion so that a curved gas flow path can be formed. In some embodiments, the inlet/outlet tube includes a first inlet/outlet tube and a second inlet/outlet tube to introduce and discharge gas. A connection housing can be installed on the tank body so as to interface individual ends of the first inlet/outlet tube and the second inlet/outlet tube with one another.

In some embodiments, it is preferred that an inner side of the connection housing comprises a rounded face to form a "U"-shaped gas flow path in the EGR cooler, a plurality of chambers formed in the connection housing and partitioned by one or more plates, and gas interface holes formed on one or more of the plates so that the chambers can be interfaced with one another.

In addition, a separator wall is installed in the tank body to form a cooling fluid flow path in which an identical quantity of cooling fluid enters and exits. A plurality of baffles can be installed in the cooling flow path. The baffles can be arranged in an alternative fashion in the cooling flow path, and in some embodiments can occupy at least half of the traverse-sectional area of the cooling flow path. Also, a cooling fluid interface hole can be defined at the separator and baffles, in which a part of the cooling fluid flows.

EGR coolers according to embodiments of the present invention are described below in detail with reference to the accompanying drawings, and are presented by way of example only.

Figure 3B:
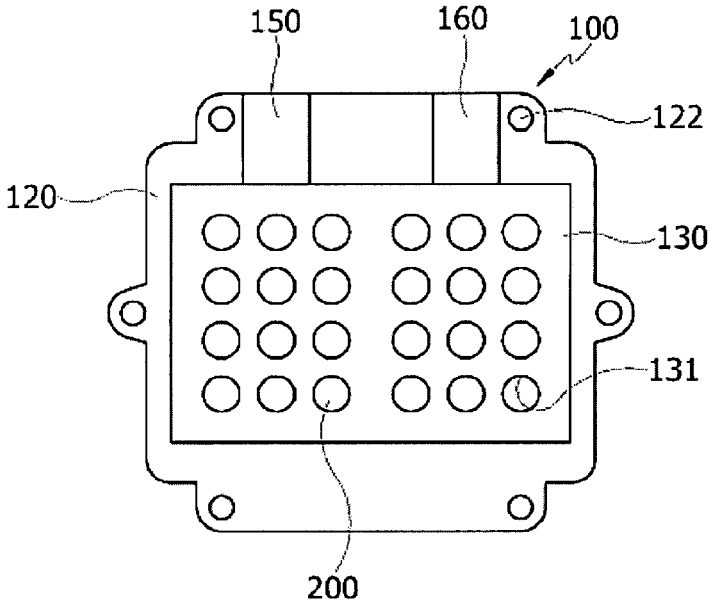
FIG. 3*b* is a rear view of the portion of the EGR cooler shown in FIGS. 2 and 3, shown from "BB" in FIG. 2.
Figure 4A:
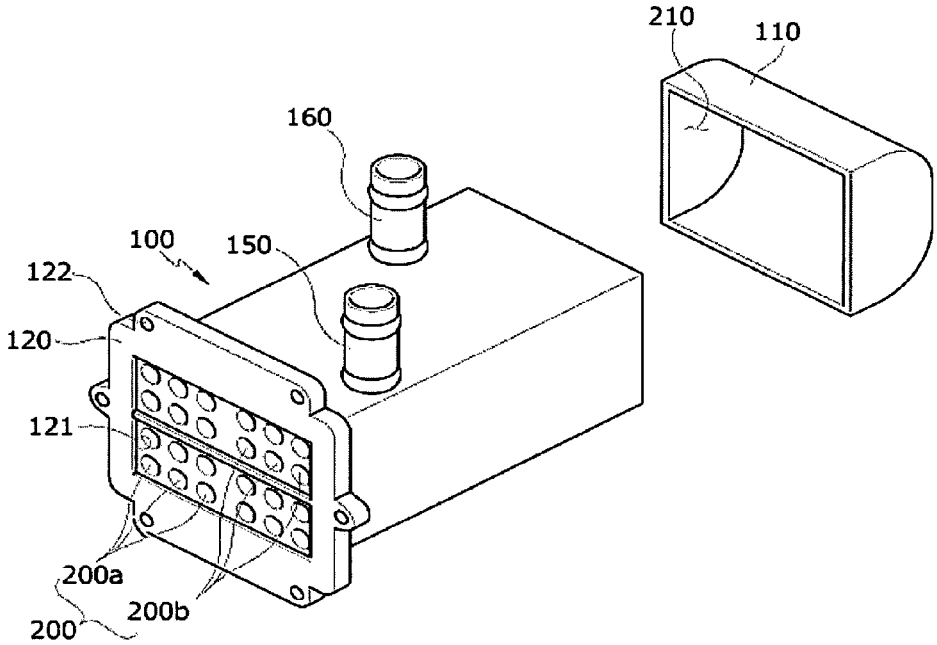
FIGS. 4*a* and 4*b* are exploded perspective views illustrating modified EGR coolers according to other embodiments of the present invention.
Figure 4B:
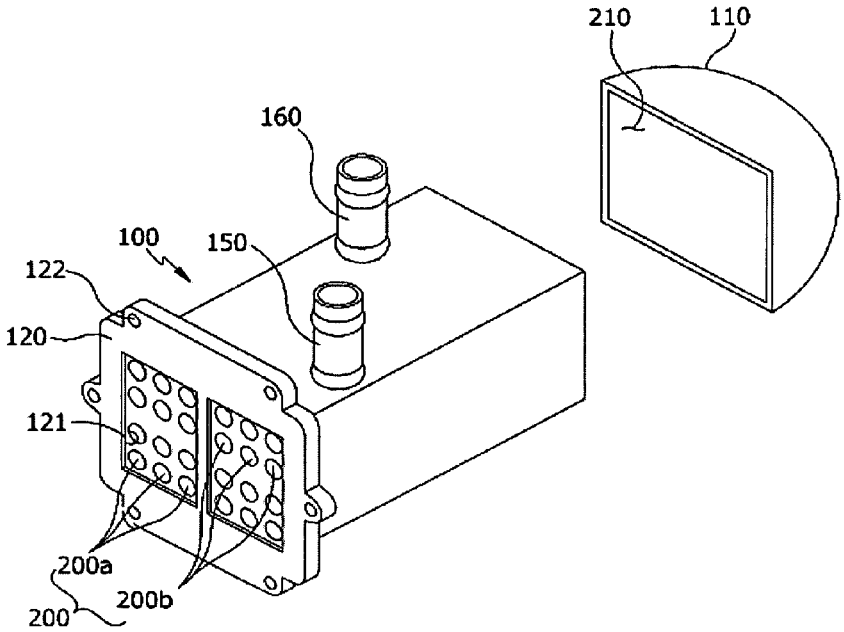

FIG. 2 is an exploded perspective view illustrating an EGR cooler according to an embodiment of the present invention, FIG. 3*a* is a vertical cross-sectional view of a portion of the EGR cooler shown in FIG. 2, shown from "AA" in FIG. 2, FIG. 3*b* is a rear view of the portion of the EGR cooler shown in FIGS. 2 and 3, shown from "BB" in FIG. 2, and FIGS. 4*a* and 4*b* are exploded perspective views illustrating modified EGR coolers according to other embodiments of the present invention.

The EGR cooler illustrated in FIGS. 2-3*b* is comprised of a tank body 100 through which cooling fluid enters and exits, and an inlet/outlet tube 200 installed in the tank body 100 by insertion. The inlet/outlet tube 200 cooperates with a connection housing 110 (described in greater detail below) to form a curved gas flow path 210.

The illustrated tank body 100 has a tubular shape with a closed face 130 at one end, and a flanged cover 120 with clamping holes 122 at its open inlet end. Here, the cover 120 covers one open face of the tank body 100. The plurality of clamping holes 122 enables the tank body 100 to be fixed to an adjacent part.

In addition, a cooling fluid inlet 150 through which cooling fluid is introduced and a cooling fluid outlet 160 through which the introduced cooling fluid is discharged are respectively formed on one side of the tank body 100. The inlet/outlet tube 200 through which gas enters and exits is inserted and fixed inside the tank body 100 relative to the cooling fluid inlet 150 and outlet 160 so that heat exchange between the gas in the inlet/outlet tube 200 and cooling fluid takes place.

In order to insert the inlet/outlet tube 200 inside the tank body 100, insertion cavities 121, 131 are formed on the closed face 130 of the tank body 100 and the cover flange 120 installed facing the closed face 130, respectively. It is preferred that the insertion cavities 121, 131 have shapes that correspond to the outer diameter of the inlet/outlet tube 200. It is also preferred that a plurality of the insertion cavities 121, 131 is formed in rows and/or columns on the closed face 130 and cover flange 120. With continued reference to the embodiment of FIGS. 1-3*b*, both ends of the inlet/outlet tube 200 are respectively fixed at the insertion cavities 121, 131. Also, a connection housing 110 is fixed and installed on the closed face 130 so that the inlet/outlet tubes 200 can be surrounded by the connection housing 110 and can interface with (i.e., be in fluid communication with) one another.

The connection housing 110 interfaces a plurality of installed inlet/outlet tubes 200 with one another so as to extend within the tank body 100 in a horizontal direction, thereby permitting gas flow among the inlet/outlet tubes 200. It is preferred that the inner face of the connection housing 110 has a rounded shape so that gas entering into and/or exiting from an inlet/outlet tube 200 fixed on the closed face 130 may flow in a "U" shape (i.e., following the inner face of the connection housing 110).

The inlet/outlet tube 200 extends and is installed along the length direction of the tank body 100, and has a tubular shape so that gas can flow therein. The inlet/outlet tube 200 can be defined by a first inlet/outlet tube 200*a* intended to introduce gas into the tank body 100, and a second inlet/outlet tube 200*b* intended to discharge the introduced gas. While the first inlet/outlet tube 200*a* and the second inlet/outlet tube 200*b* are not necessarily technically specified, it will be appreciated that the first inlet/outlet tube 200*a* is defined as that portion of the inlet/outlet tube 200 into which gas is introduced, and that the second inlet/outlet tube 200*b* is defined as that portion of the inlet/outlet tube 200 from which gas is exhausted from the tank body 100.

According to some embodiments of the present invention, the first and second inlet/outlet tubes 200*a*, 200*b* have a configuration in which they are positioned in side-by-side relationship on opposite sides of the center of the tank body 100. However, as illustrated in FIG. 4*a*, the first inlet/outlet tube 200*a* can instead be installed on a bottom of the tank body 100, while the second inlet/outlet tube 200*b* can be installed at the top of the tank body 100. In such a case, it is preferred that the connection housing 110 is configured to have a rounded "U"-shaped inner face curved from bottom to top, and through which gas introduced at the bottom of the tank body 100 can move to the top along the inner face of the connection housing 110 before it is exhausted through the top of the tank body 100.

In addition, as illustrated in FIG. 4*b*, the inner face of the connection housing 110 can also be formed so as to have a rounded interior surface in both top-bottom and lateral directions. That is, the inner side of the connection housing 110 can be rounded in a top and bottom direction and in a left and right direction. Also, the connection housing 110 can be formed to have a semi-spherical interior surface. Subsequently, gas introduced in the connection housing 110 can move smoothly along the inner rounded face of the connection housing 110.

Figure 5:
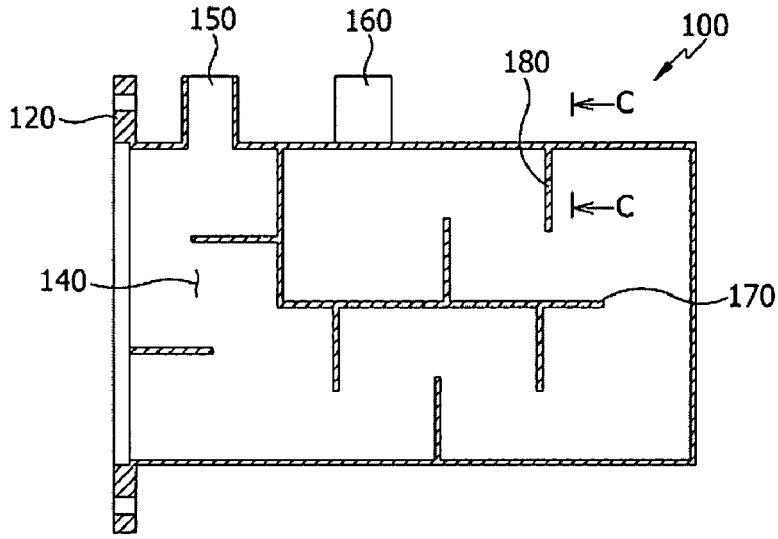
FIG. 5 is a diagram schematically illustrating configurations of a separator and baffle of an EGR cooler according to an embodiment of the present invention.

FIG. 5 schematically represents an exemplary configuration of a separator and baffle of an EGR cooler according to an embodiment of the present invention, and is a drawing obtained by deleting the configuration of the inlet/outlet tube from FIG. 4.

As illustrated in FIG. 5, a separator wall 170 is located in the interior of the tank body 100, and guides movement of cooling fluid flowing from a cooling fluid inlet 150 to a cooling fluid outlet 160. While the separator wall 170 forms a cooling flow path 140 within the interior of the tank body 100 through which cooling fluid moves, a plurality of baffles 180 can be located in the cooling flow path 140, and can be oriented in a direction perpendicular to the direction of cooling fluid flow. The baffles 180 can be formed so as to occupy at least half of the traverse section on the cooling flow path 140, and can extend into the cooling flow path from opposite sides thereof so that cooling fluid moving along the cooling flow path 140 must flow in a zigzag fashion. As a result, the cooling flow path 140 along which cooling fluid moves can be effectively extended.

While a relatively straight tube through which gas moves is in heat transfer relationship with cooling fluid flowing in one direction for a relatively short period of time to achieve heat exchange in many prior art EGR coolers, a tube that enables a "U"-shaped gas flow is in heat transfer relationship with cooling fluid flowing in a zigzag mode for a sufficient period to promote heat transfer in some embodiments of the EGR cooler of the present invention. Accordingly, elevated heat transfer efficiencies can be obtained.

Figure 6A:
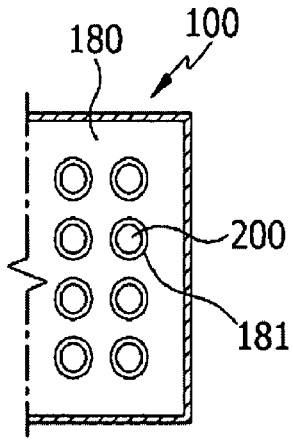
FIG. 6*a* is a front view of a baffle shown in FIG. 5, shown from "CC" in FIG. 5.
Figure 6B:
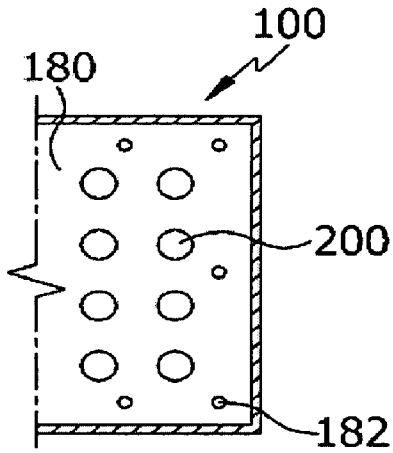
FIG. 6*b* is a front view of an alternative baffle shown in FIG. 5, shown from "CC" in FIG. 5.

FIG. 6*a* is a front view of a baffle illustrating in FIG. 5, shown along lines "CC", whereas FIG. 6*b* is a front view of a modified baffle for the same purpose. As illustrated in FIG. 6*a*, through holes 181 can be formed in the baffle 180. A plurality of inlet/outlet tubes 200 can be inserted through the holes 181 and into the tank body 100. It is preferred that the through holes 181 are formed so that their outer diameter is the same as that of the inlet/outlet tubes 200, or are larger by a certain diameter. If the through holes 181 are formed so that their diameters are larger than the outer diameter of the inlet/outlet tubes 200, a gap is formed between the outer diameter of the inlet/outlet tubes 200 and the through holes 181, and a part of the cooling fluid that flows along a cooling flow path 140 can flow through this gap.

In addition, and as illustrated in FIG. 6*b*, a plurality of cooling fluid interface holes 182 can be defined in the baffle 180, and enable a portion of the cooling fluid flowing in the cooling flow path 140 to move therethrough. Accordingly, if pressure in a certain location within the tank body 100 exceeds a certain value, a portion of the cooling fluid flowing through the cooling flow path 140 can flow through the cooling fluid interface holes 182 so that the overall flow of cooling fluid in the tank body 100 can be facilitated. Although not illustrated, such cooling fluid interface holes 182 can be defined not only in one or more baffles 180, but also or instead in the separator wall 170, thereby maintaining smooth cooling fluid flow in the tank body 100.

Figure 7:
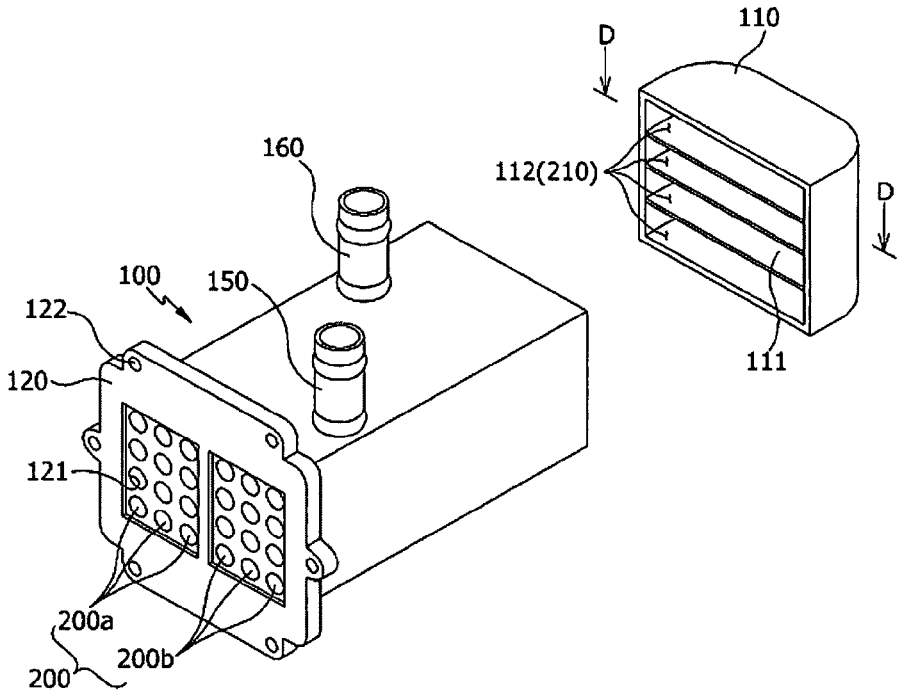
FIG. 7 is an exploded perspective view of an EGR cooler according to another embodiment of the present invention.
Figure 8:
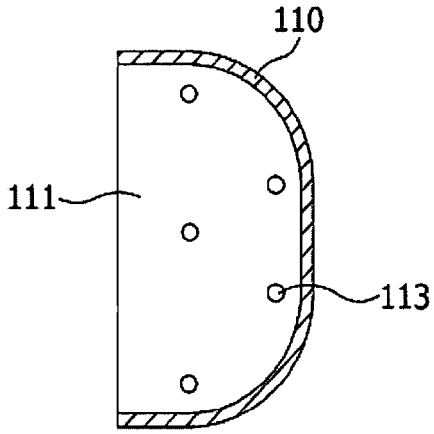
FIG. 8 is a vertical cross-sectional view of a portion of the EGR cooler shown in FIG. 7, shown from "DD" in FIG. 7.

FIG. 7 is an exploded perspective view of an EGR cooler according to another embodiment of the present invention, and FIG. 8 is a detail view of the EGR cooler taken along lines "DD" FIG. 7. As illustrated in FIG. 7, a plurality of walls or plates 111 can be provided inside the connection housing 110 for splitting the height of the connection housing 110 into portions corresponding to a plurality of insertion cavities 121, 131 in the closed face 130. As these walls 111 partition the inner space of the connection housing 110 into a plurality of chambers 112, the insertion cavities 131 of the closed face 130 that are located at the same height are thereby interfaced with one another. Thus, since the chambers 112 interface those inlet/outlet tubes 200 located at the same height, after gas is introduced from the first inlet/outlet tube 200*a* to respective chambers 112, the introduced gas moves along the inner faces of an applicable connection housing 110 before it is exhausted through respective portions of the second inlet/outlet tube 200*b*.

As illustrated in FIG. 8, a plurality of gas interface holes 113 can be defined in one or more of the plates 111, thereby permitting a portion of the gas to flow therethrough. Since such gas interface holes 113 establish a degree of fluid communication between chambers 112 at different locations, pressure differences that may be generated between different chambers 112 can be reduced, thereby improving gas flow.

Comparing the case of connection housings 110 in which walls 111 are provided with the case of connection housings 110 in which such walls 111 are not provided, gas flow in each connection housing 110 can be compared as follows.

First, in the case of connection housings 110 in which walls 111 are not present (refer to FIG. 2), gas introduced into such connection housings 110 can be mixed to form a turbulent flow so that pressure losses may increase, and impurities such as soot contained in the gas may tend to accumulate inside the connection housing 110. On the contrary, in the case of the connection housings 110 having the walls 111 (refer to FIG. 6), gas at the top and bottom of the connection housing 110 is not mixed with each other by virtue of the walls 111, so gas flow is facilitated. Consequently, in some embodiments, pressure losses incurred by gas can be reduced and accumulation of impurities such as soot can be prevented.

While the present invention has been illustrated and described with reference to specific embodiments, it would be evident to a person skilled in the art that the present invention can be improved and changed in a variety of ways without departing from the spirit and scope of the invention.

Accordingly, sufficient thermal contact between gas flowing inside the inlet/outlet tubes of the tank body and cooling fluid flowing outside the inlet/outlet tubes can be achieved, and heat transfer time can be improved for greater heat exchange efficiencies between the gas and cooling fluid. In addition, some embodiments of the present invention can prevent the accumulation of impurities contained in the gas. Furthermore, embodiments of the present invention have an advantage over existing straight EGR coolers in that they can be positioned and installed in harmony with other parts of a vehicle.

What is claimed is:

1. An EGR cooler comprising:

a tank body through which cooling fluid enters and exits;

a tube within the tank body and at least partially defining a gas flow path through the tank body, the tube comprising a first portion through which gas entering the EGR cooler passes, and a second portion through which gas exiting the EGR cooler passes; and a connection housing establishing fluid communication between the first and second portions of the tube, the connection housing including a plurality of chambers defined within the connection housing by at least one interior wall of the connection housing and at least one hole defined in the at least one interior wall of the connection housing for establishing fluid communication between at least two of the plurality of chambers;

wherein the first and second portions of the tube and the connection housing collectively define a curved gas flow path through the EGR cooler.

2. The EGR cooler of claim 1, wherein the connection housing has a rounded inner surface at least partially defining a "U" shape of the gas flow path in the EGR cooler.

3. The EGR cooler of claim 1, further comprising at least one hole defined through the at least one interior wall of the connection housing, and establishing fluid communication between at least two of the plurality of chambers.

4. The EGR cooler of claim 1, further comprising a wall within the tank body and at least partially defining two lengths of a cooling fluid flow path in which an identical quantity of cooling fluid enters and exits the tank body.

5. The EGR cooler of claim 2, further comprising a wall within the tank body and at least partially defining two lengths of a cooling fluid flow path in which an identical quantity of cooling fluid enters and exits the tank body.

6. The EGR cooler of claim 1, further comprising:

a cooling flow path through which coolant passes in the EGR; and a plurality of baffles in the cooling flow path.

7. The EGR cooler of claim 5, further comprising at least one hole defined through the wall and through which a portion of the cooling fluid flows in the cooling flow path.

8. The EGR cooler of claim 6, wherein the baffles extend into the cooling flow path in an alternating arrangement from opposite sides of the cooling flow path.

9. The EGR cooler of claim 6, wherein the baffles extend across at least half of the cooling flow path.

10. An EGR cooler, comprising:

a tank having a first portion within which extends a first set of tubes and a second set of tubes, and a second portion establishing fluid communication between the first and second sets of tubes, the first set of tubes, the second set of tubes, and the second portion collectively defining a U-shaped flow path for exhaust gas through the EGR cooler;

a coolant inlet;

a coolant outlet;

a wall separating the second portion of the tank into at least two different internal chambers; and at least one aperture defined through the wall and establishing fluid communication between the different internal chambers;

wherein the second portion of the tank has a curved interior surface along which exhaust gas flows from the first set of tubes to the second set of tubes.

11. The EGR cooler of claim 10, further comprising a wall separating the tank into the first and second portions.

12. The EGR Cooler of claim 10, further comprising another wall separating flow from the first set of tubes to the second set of tubes.

13. The EGR cooler of claim 10, further comprising a plurality of baffles extending into a path of coolant fluid flow through the EGR cooler.

14. The EGR cooler of claim 13, wherein the plurality of baffles extend into the path of coolant fluid flow in an alternating manner from opposite sides of the path of coolant fluid flow.

* * * * *